US010661280B1

(12) United States Patent
Williams et al.

(10) Patent No.: US 10,661,280 B1
(45) Date of Patent: May 26, 2020

(54) ROCK CRUSHER APPARATUS AND METHOD

(71) Applicants: Tracy Diana Williams, South Plainfield, NJ (US); Janusz Robert Trojanowski, South Plainfield, NJ (US)

(72) Inventors: Tracy Diana Williams, South Plainfield, NJ (US); Janusz Robert Trojanowski, South Plainfield, NJ (US)

( * ) Notice: Subject to any disclaimer, the term of this patent is extended or adjusted under 35 U.S.C. 154(b) by 0 days.

(21) Appl. No.: 16/542,557

(22) Filed: Aug. 16, 2019

(51) Int. Cl.
*B02C 1/04* (2006.01)

(52) U.S. Cl.
CPC ..... *B02C 1/04* (2013.01)

(58) Field of Classification Search
CPC .... B30B 1/02; B30B 1/04; B30B 1/08; B30B 1/12; B02C 1/005; B02C 1/02; B02C 1/04; B02C 1/10
See application file for complete search history.

(56) References Cited

U.S. PATENT DOCUMENTS

| | | | | |
|---|---|---|---|---|
| 2,836,845 | A * | 6/1958 | Farchmin | A22C 21/066 452/166 |
| 5,474,633 | A * | 12/1995 | Myers | B30B 1/04 156/230 |
| 2012/0217329 | A1* | 8/2012 | Livermore | B02C 1/04 241/37.5 |
| 2016/0228878 | A1 | 8/2016 | Smith | |

FOREIGN PATENT DOCUMENTS

| | | | | |
|---|---|---|---|---|
| CN | 205008495 U | * | 2/2016 | B21D 39/00 |
| DE | 102008006105 A1 | * | 8/2009 | B30B 1/08 |

OTHER PUBLICATIONS http://www.crazycrusher.com/, Aug. 16, 2019.

* cited by examiner

*Primary Examiner* — Teresa M Ekiert
*Assistant Examiner* — Jared O Brown
(74) *Attorney, Agent, or Firm* — Walter J. Tencza, Jr.

(57) ABSTRACT

An overall apparatus including a known manually operated rock crusher which includes at least one bar; wherein an end of the at least one bar is moved manually, and then downwards to cause the crushing of rocks; and further including an assistance device configured to be attached to the at least one bar; and a switch activated by an activation device; wherein in response to activation of the switch by the activation device, the assistance device applies a force to the at least one bar and then the switch is deactivated to move back to an original position and orientation, to thereby crush rocks. The assistance device may further include an air compressor; a piston assembly having a piston rod and a piston housing; wherein the piston rod moves outward from the piston housing to apply force to the at least one bar and then back inward during a downstroke.

11 Claims, 6 Drawing Sheets

ROCK CRUSHER APPARATUS AND METHOD

FIELD OF THE INVENTION

This invention relates to devices for crushing rocks.

BACKGROUND OF THE INVENTION

Manually operated rock crushers are generally known in the art. Typically, manually operated bar(s) or lever(s) are rotated upwards to move one plate closer to another plate and in position with respect to the other plate to cause crushing of rocks placed between the two plates. One known manually operated rock crusher is called the "Crazy Crusher" (trademarked) and is described at crazycrusher-.com and manufactured by GoldQuest, LLC of Arizona. Manually operated rock crushers may be difficult to operate.

SUMMARY OF THE INVENTION

In at least one embodiment, an apparatus is provided comprising a known manually operated rock crusher which includes at least one bar; wherein the at least bar is moved manually to cause the crushing of rocks; and further comprising an assistance device configured to be attached to the at least one bar; and a switch activated by an activation device; wherein in response to activation of the switch by the activation device, the assistance device applies a force to the at least one bar to cause the at least one bar to move to thereby crush rocks.

In at least one embodiment, the at least one bar includes a first bar and a second bar; wherein the first bar is spaced apart and parallel to the second bar; wherein the assistance device is attached to the first bar and the second bar through a third bar; wherein the third bar has a first end closer to the first bar than the second bar and a second end, which opposes the first end, and which is closer to the second bar than the first bar.

The apparatus may further include an air compressor; and wherein the assistance device includes a piston assembly having a piston rod and a piston housing; wherein the piston rod moves outward from the piston housing to apply force to the at least one bar to thereby apply a force to the at least one bar to thereby crush rocks. Alternatively or additionally, in at least one embodiment, rocks may be crushed on the downstroke when someone releases the switch and when the at least one bar comes downwards and the piston rod retracts.

The apparatus may further include a spring; and a base; wherein the manually operated rock crusher is fixed to the base; wherein the spring is attached at one end to the at least one bar and at an opposite end to the base; and wherein the spring exerts a force to the at least one bar which is substantially opposite the force applied by the assistance device to the at least one bar. The piston housing may include a piston cylinder. The piston cylinder may have first end which is fixed to the base, and a second end which is opposite the first end, and which is closer to the at least one bar than to the base; wherein the base has a first height level to which the manually operated rock crusher is fixed; wherein the base has a second height level to which the first end of the piston cylinder is fixed; and wherein the first height level is at a greater height than the second height level.

A method is provided in accordance with one or more embodiments of the present invention. The method may include the attaching an assistance device to at least one bar of a manually operated rock crusher; wherein the at least bar is moved manually to cause the crushing of rocks; wherein the assistance device includes a switch having an activation device; and wherein in response to activation of the switch by the activation device, the assistance device applies a force to the at least one bar to cause the at least one bar to move, and then the switch is typically deactivated to cause a downstroke of the at least one bar, back to an original position, to thereby crush rocks typically during the downstroke.

The assistance device may be configured as previously disclosed.

DETAILED DESCRIPTION OF THE DRAWINGS

Figure 1:
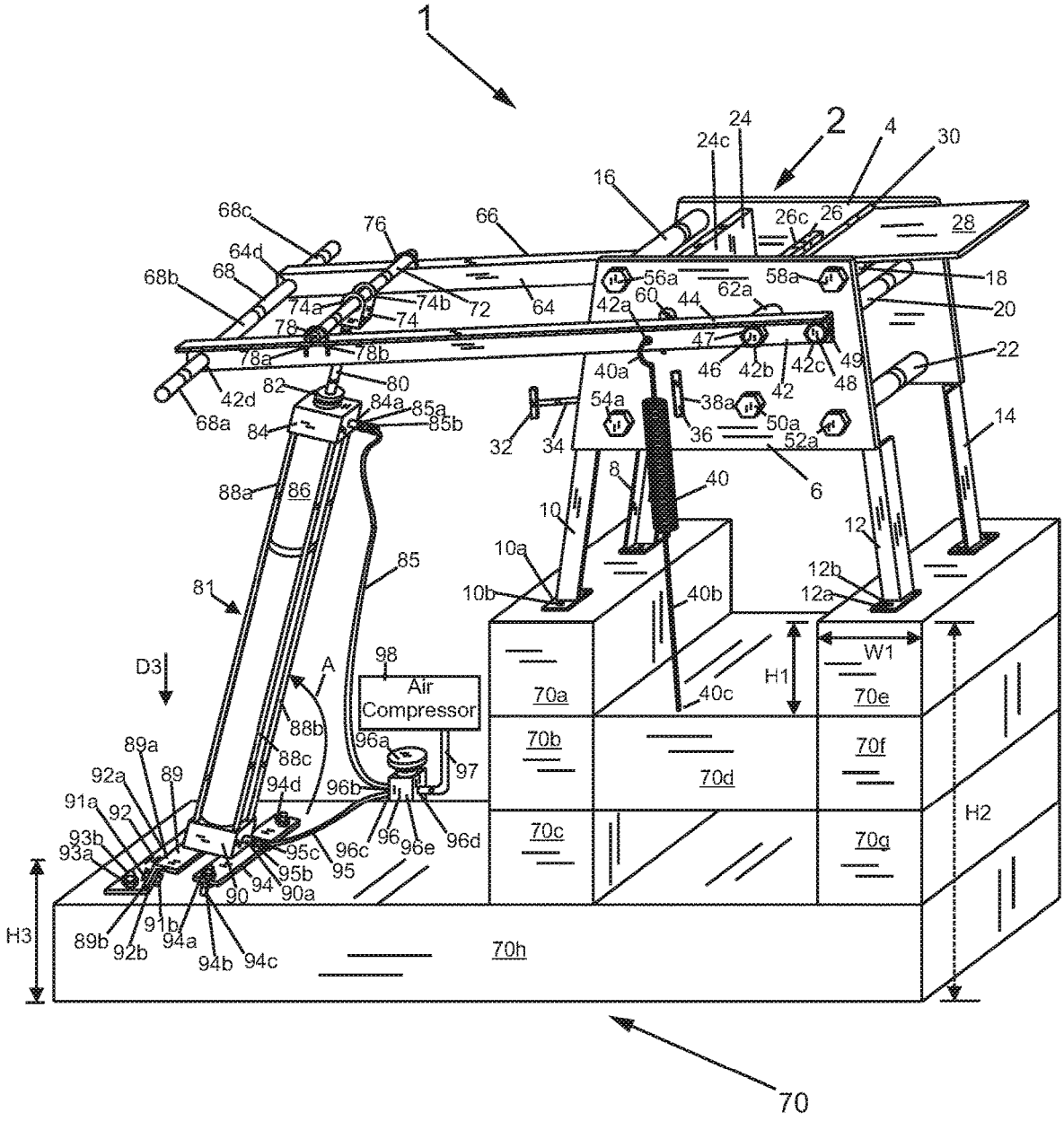
FIG. 1 is a top, front, and right perspective view of an apparatus in accordance with an embodiment of the present invention, with the apparatus shown in a first state.
Figure 2:
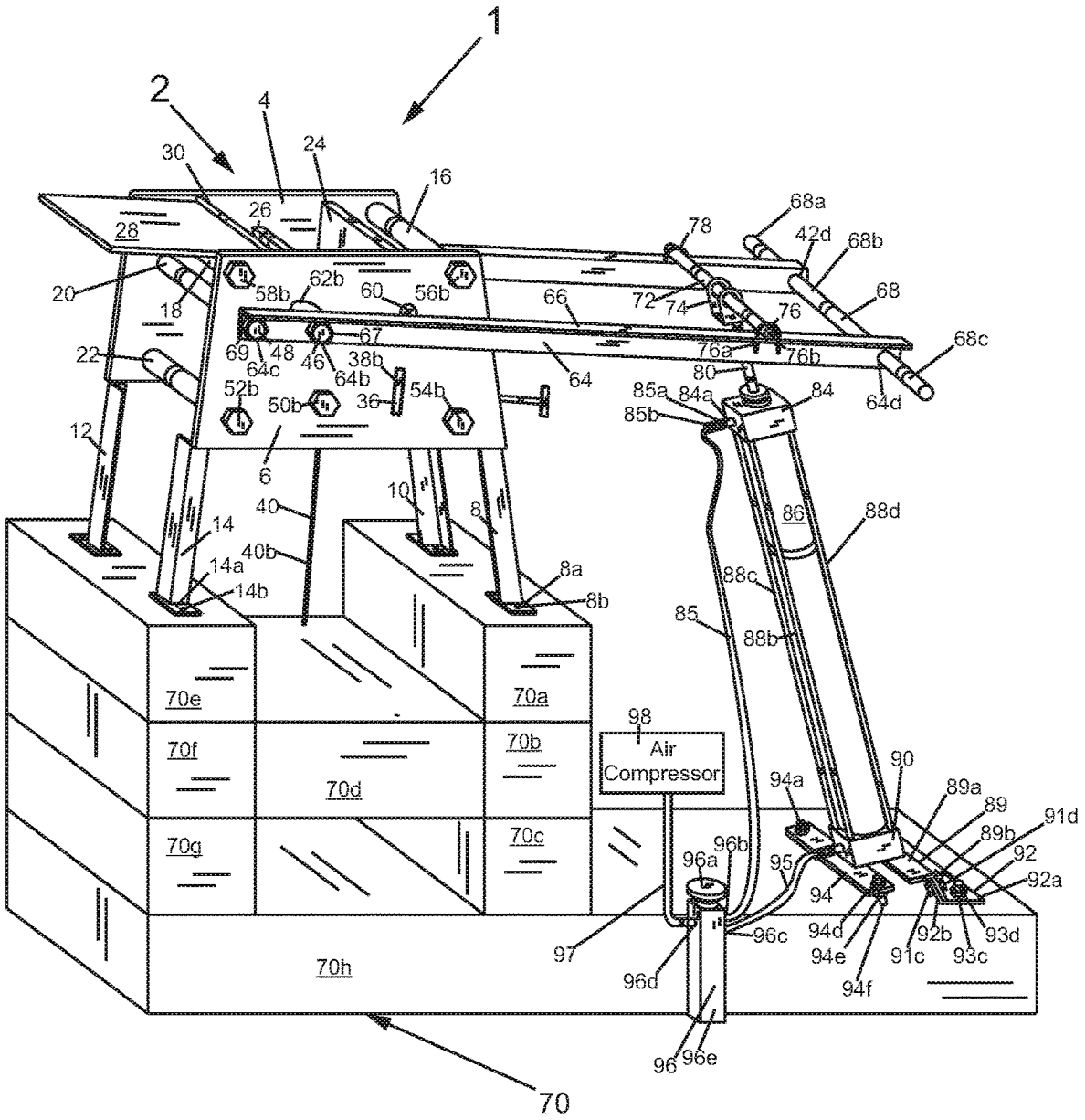
FIG. 2 is a top, front, and left perspective view of the apparatus of FIG. 1 in the first state.

FIG. 1 is a top, front, and right perspective view of an apparatus 1 in accordance with an embodiment of the present invention, with the apparatus 1 shown in a first state. FIG. 2 is a top, front, and left perspective view of the apparatus 1 of FIG. 1 in the first state.

The apparatus 1 includes a rock crusher 2 which is known in the art. The rock crusher 2 may be a hand operated rock crusher, such as the Crazy Crusher (trademarked), as shown at crazycrusher.com made by GoldQuest, LLC of Arizona.

The rock crusher 2 may be made entirely or substantially of steel. The rock crusher 2 may include plates 4 and 6 which are typically parallel or substantially parallel to each other and each of which may have an isosceles trapezoidal shape. Referring to FIGS. 1 and 2, the plates 4 and 6 may be fixed together by bolts 56*a*, 58*a*, 54*a*, 50*a*, and 52*a* which are inserted, at least partially, through spacers or tubes 16, 18, a tube analogous to 18 not shown, a tube analogous to 18 not shown, and tube 22, and which are inserted at least partially through and which are held by nuts 56*b*, 58*b*, 54*b*, 50*b*, and 52*b*, respectively.

The rock crusher 2 may further include legs or supports 8 and 14 which are fixed, such as by welding to plate 4 and legs or supports 10 and 12 which are fixed, such as by welding to plate 6.

The rock crusher 2 may also include a pivot bar 48 at least partially inserted through a spacer or tube 20 and held by a nut 49 at one end of the pivot bar 48, and another nut 69 at an opposite end of the pivot bar 48. The rock crusher 2 further includes metal beam or bar 42 fixed at a right angle to metal beam or bar 44, and metal beam or bar 64 fixed at a right angle to metal beam or bar 66. The combination of bars 42 and 44 form a lever arm, as does the combination of bars 64 and 66. The pivot bar 48 passes at least partially through an opening 42*c* in the bar 42 and through an opening 64*c* in the bar 64. The pivot bar 48 may be a solid metal cylinder.

The rock crusher 2 further includes a bar 46, which at least partially passes through an opening 42*b* in the bar 42 and through an opening 64*b* in the bar 64. The bar 46 is held to the bar 42 by a nut 47 and to the bar 64 by a nut 67. The bar 46 is fixed, such as by welding to a plate 26. The plates 4 and 6 have arcuate slots 62*b* and 62*a*, respectively. Lifting one end of the bars 64 66, 42, and 44 from the position shown in FIGS. 1 and 4 using handles 68*a*, 68*c*, and thereby rotating the bars 64, 66, 42, and 44, about pivot pin, bar, or solid cylinder 48 to the position shown in FIG. 6, causes the bar or solid cylinder 46, and the plate 26 to which it is fixed to move upwards and to the right, from FIG. 1 to FIG. 6, in slots 62*a*, shown in FIG. 1, and 62*b*, shown in FIG. 2. This also results in rotation of the plate 26, which causes an end 26*a* of the plate 26 to move closer to the plate 24. As shown in FIG. 4, the end 26*a* is a distance D1 from the plate 24, and in FIG. 6, the end 26*a* is a distance D2, which is less than D1, to the plate 24. The plate 26 has rotated from FIG. 4 to FIG. 6, so that the top end 26*b*, opposite the bottom end 26*a*, is now farther away from the plate 24. Lifting one end of the bars 64, 66, 42 and 44, and thereby rotating the bars 64, 66, 42, and 44, about pivot pin, bar, or solid cylinder 48 causes rocks in between the plates 24 and 26 to be crushed by end 26*a* moving towards plate 24. Alternatively or additionally, in at least one embodiment, rocks may be crushed during the downstroke when someone releases the switch button 96*a* of switch 96 and as the ends of the bars 42, 44, 64, and 66 come downwards and as the bars 42, 44, 64, and 66 rotate back from the position of FIG. 6 to the position of FIG. 4, and as the piston rod 80 retracts. During the downstroke the plate 26 moves downward with respect to the plate 24 and towards the base 70, and the plate 26 rotates from the position and orientation shown in FIG. 6 to the position and orientation shown by FIG. 4, which may crush rocks between the surfaces 24*c* and 26*c* of the plates 24 and 26, respectively.

The rock crusher 2 may further include a plate 36 which sits in slots 38*a* and 38*b*. A bolt or screw 34 is screwed into an opening 36*a*, shown by dashed lines in FIG. 4, of the plate 36, and the bolt 34 can be adjusted by using attached handle 32 to adjust the orientation of the plate 24, with respect to the plate 26. The bolt or screw 34 adjusts the closeness of the plate 24 to the plate 26 in order to produce a different size crushed rock when the rock crusher 2 is operated. The plate 24 is fixed, such as by welding to a cylindrical bar 60, which spins freely in openings of the plate 6 and the plate 4.

Figure 6:
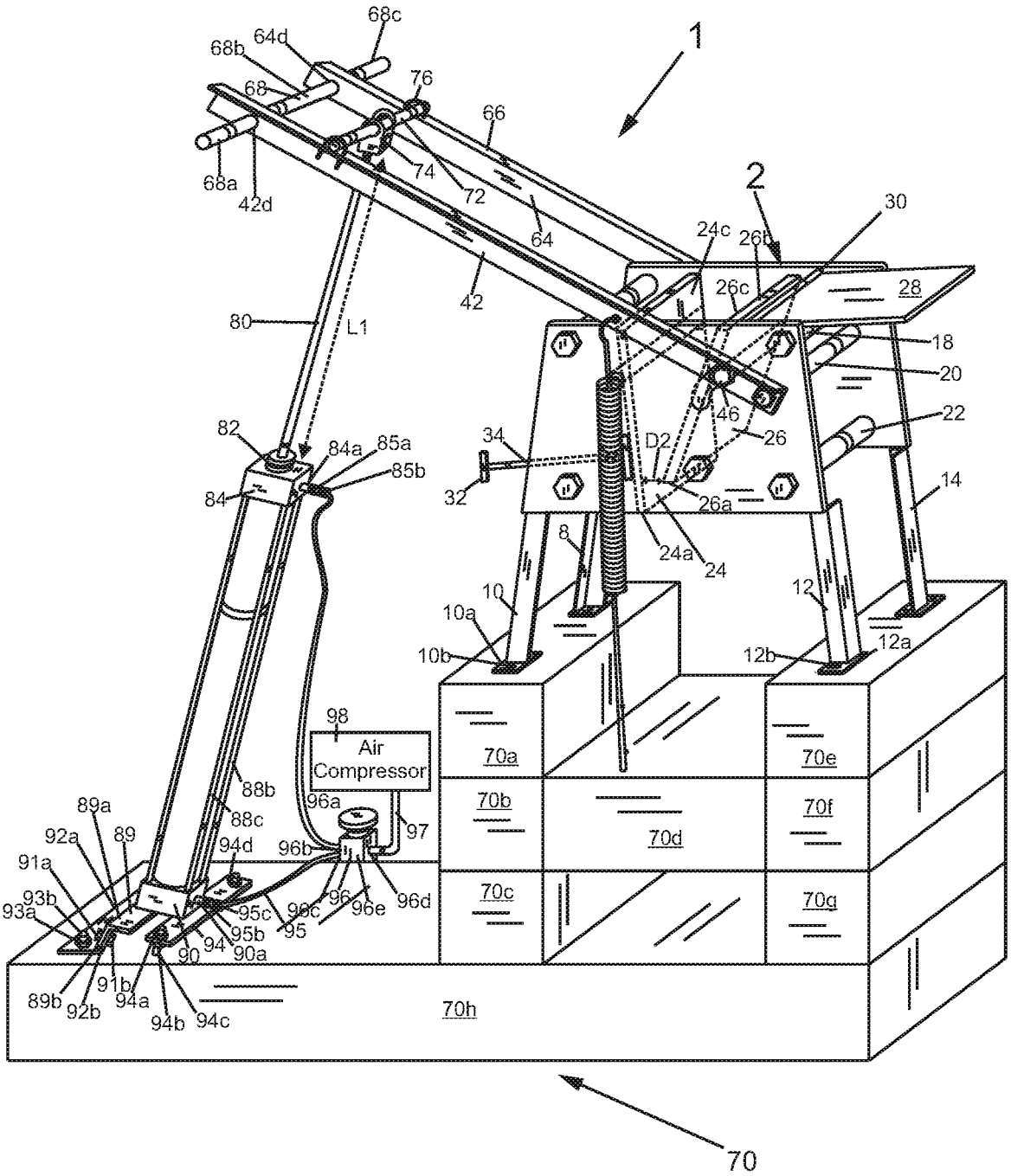
FIG. 6 is a top, front, and right perspective view of the apparatus of FIG. 1, with the apparatus shown in a third state, and with the locations of various components shown by dashed lines.

The rock crusher 2 includes a handle 68 fixed to the bars 42 and 64. The handle 68 includes sections 68*a*, 68*b*, and 68*c*. The handle 68, at least partially is inserted through openings 42*d* and 64*d* of the bars 42 and 44. A person can grasp the handle 68 with both hands and push or pull the handle 68 to thereby rotate the bars 42, 44, 64, and 66 from the position of FIG. 4 to the position of FIG. 6, to thereby cause rocks between plates 24 and 26 to be crushed. The plates 24 and 26 have surfaces 24*c* and 26*c*, whose locations are shown by FIGS. 1 and 6, which generally face each other, and which are rough or textured in a manner to facilitate the crushing of rocks. The texture of the surfaces 24*c* and 26*c* may be created by welding metal to the plates 24 and 26, which is called a "hard weld" and is known in the art.

In accordance with at least one embodiment of the present invention, various components have been combined with the known rock crusher 2 to form an apparatus 1.

The apparatus 1 includes a base 70. The base 70 may include sections 70*a*, 70*b*, 70*c*, 70*d*, 70*e*, 70*f*, 70*g*, and 70*h*. Each of the sections 70*a*-70*h* may be made of solid wood or of another solid heavy material. The sections 70*a-h* may be combined in one integrated unit. Bottoms of legs 8, 10, 12, and 14 are securely fixed, and mounted to the base 70 such as by screws, bolts, or glue, however, glue would not be preferred since it would not be strong enough to hold the bottoms of legs 8, 10, 12, and 14 securely enough to base 70 during operation of apparatus 1.

The apparatus 1 further includes a piston housing or cylinder 86 along with supports rods 88*a*, 88*b*, 88*c*, 88*d*, members 84, and 90, connector 82, and piston rod 80. The components 86, 88*a-d*, 84, 90, 82, and 80 all may be described as part of a piston assembly or apparatus 81. The member 90 and the piston cylinder 86 are preferably mounted at an angle, such as an angle A, with respect to section 70*h* of the base 70 and with respect to a ground surface which is parallel or substantially parallel to section 70*h* and on which section 70*h* rests. The angle A is preferably less than ninety degrees, and it is preferable in one embodiment that the angle A be about seventy-five degrees, to provide adequate leverage, to allow ends of the bars 42, 44, 64, and 66 to be efficiently pushed upwards and lifted to cause rotation of the bars 42, 44, 64, and 66 about the pivot pin, bar, or solid cylinder 48 from the state of FIG. 4 to the state of FIG. 6.

The member 90 is mounted to a plate 94. The plate 94 is fixed at an angle with respect to the section 70*h* of the base 70 in order to fix the piston housing or cylinder 86 at an angle A. The plate 94 is fixed by bolt 94*b*, nut 94*a* and nut 94*c* at one end of plate 94 and by bolt 94*e*, and nuts 94*d* and 94*f* at another end of plate 94.

The member 90 is also mounted to an L-shaped plate or elongated bracket 89, having plates 89*a* and 89*b*, which may be perpendicular to each other. The L-shaped plate 89 is mounted to another L-shaped plate 92 by nut 91*a* and bolt 91*b* and nut 91*c* and bolt 91*d*. L-shaped plate 92 has plates 92*a* and 92*b*. The plate 92*b* is mounted to the plate 89*b* of the L-shaped plate 89 by 91*a*, 91*b*, 91*c*, and 91*d*. The plate 92*a* lies flat on the top surface of section 70*h* of the base 70. It is preferred that the plates 92*a* and 92*b* be at an angle of greater than ninety degrees with respect to each other, in order to fix the piston cylinder 86 at the angle A shown in FIG. 1. The plate 92*a* may be mounted to the section 70*h* by bolt 93*b* and nut 93*a* shown in FIG. 1, and bolt 93*d*, and nut 93*c* shown in FIG. 2.

The piston rod 80 is connected to member 74 which has openings 74*a* and 74*b* through which a cylindrical rod 72 is at least partially inserted. The cylindrical rod 72 is fixed at one end to bar 44 by U-shaped bolt 78 and nuts 78*a* and 78*b* and at an opposite end of rod 72 to bar 66 by U-shaped bolt 76 and nuts 76*a* and 76*b*.

The member 90 related to piston cylinder 86, may have a connector or outlet 90*a* which is connected to connectors 95*b* and 95*c*, which are connected to one end of a tube 95. The tube 95 is hollow to allow air to pass through tube 95. Tube 95 may be connected to a switch 96 through a coupler 96*c*. The switch 96 may be also connected through a coupler 96*b*, to one end of a tube 85. The opposite end of the tube 85 is connected via connectors 85*a* and 85*b* and coupler 84*a* to member 84. The switch 96 may be a toggle switch. The switch 96 may also be connected to an air compressor 98 through a hollow tube 97. The air compressor 98 may be a known air compressor and is shown in a simplistic block diagram form in FIG. 1. The switch 96 may have a button 96*a* which can be stepped on by a user to cause the piston rod 80 of the piston assembly or apparatus 81 to move upwards from the piston housing or piston cylinder 86 to push the bars 42, 44, 64, and 66 from the state of FIG. 4 to the state of FIG. 6. Stepping on the switch 96*a* down in the direction D3, shown in FIG. 1, causes air from the air compressor 98 to be supplied from the tube 97 to an inner chamber of the piston cylinder 86 of the piston assembly 81, via coupler 96*d*, member 96*e*, coupler 96*c*, tube 95, connectors 95*c* and 95*b*, and coupler 90*a*, and member 90, which cause the piston rod 80 to move outwards from the position of FIG. 4 to the position of FIG. 6.

When force is no longer pushing down on the button 96*a* in the direction D3, such that the button 96*a* is released, air will no longer be supplied via tube 95 to member 90 and to the chamber inner of the piston cylinder 86, and air will be released from the inner chamber of the piston cylinder 86 through member 84, coupler 84*a*, connectors 85*a-b* and tube 85, which will cause retraction of the piston rod 80 into the inner chamber of piston cylinder 86.

The apparatus 1 may also include a spring 40 which is fixed to a hook 40*a* at one end, and which is fixed to the section 70*d* of the base 70, at an end 40*c*. The hook 40*a* is fixed through an opening 42*a* to the bar 42. When the bar 42 is moved from the position shown in FIG. 4 to the position shown in FIG. 6, the spring expands which exerts a force on the bars 42, 44, 64, and 66 back towards the initial position of FIG. 1 and FIG. 4. The spring 40 is preferred to assist the piston rod 80 to move the bars 42, 44, 64, and 66 back to the position of FIG. 4 from the position of FIG. 6, because the piston cylinder 86 typically may provide more force when moving from the position of FIG. 4 to the position of FIG. 6, then from moving back to the initial state of FIG. 4 from FIG. 6. In some embodiments, the spring 40 may not be necessary. The spring 40 may be particularly useful when crushing very hard rocks.

Figure 3:
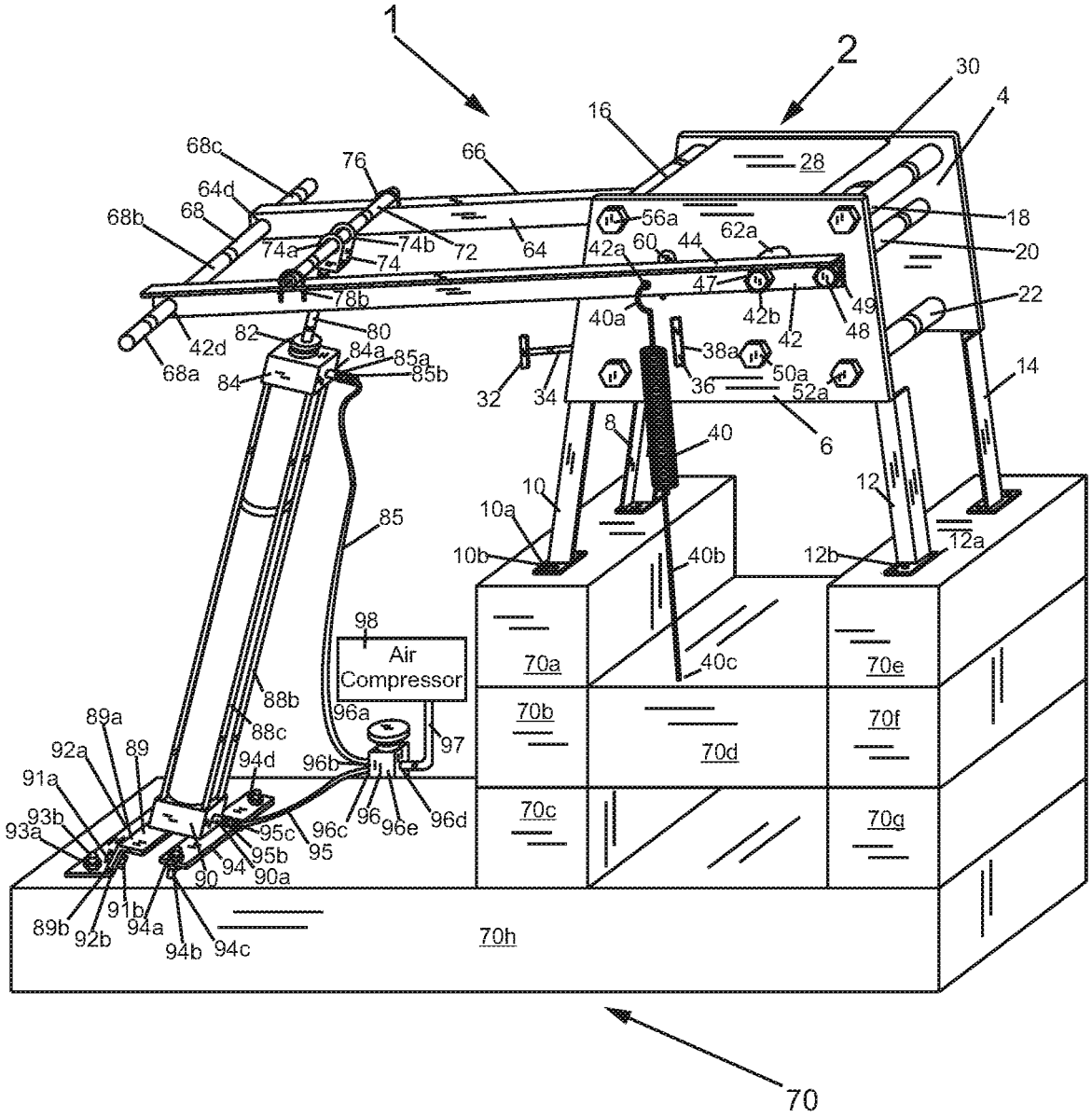
FIG. 3 is a top, front, and right perspective view of the apparatus of FIG. 1, with the apparatus shown in a second state.
Figure 4:
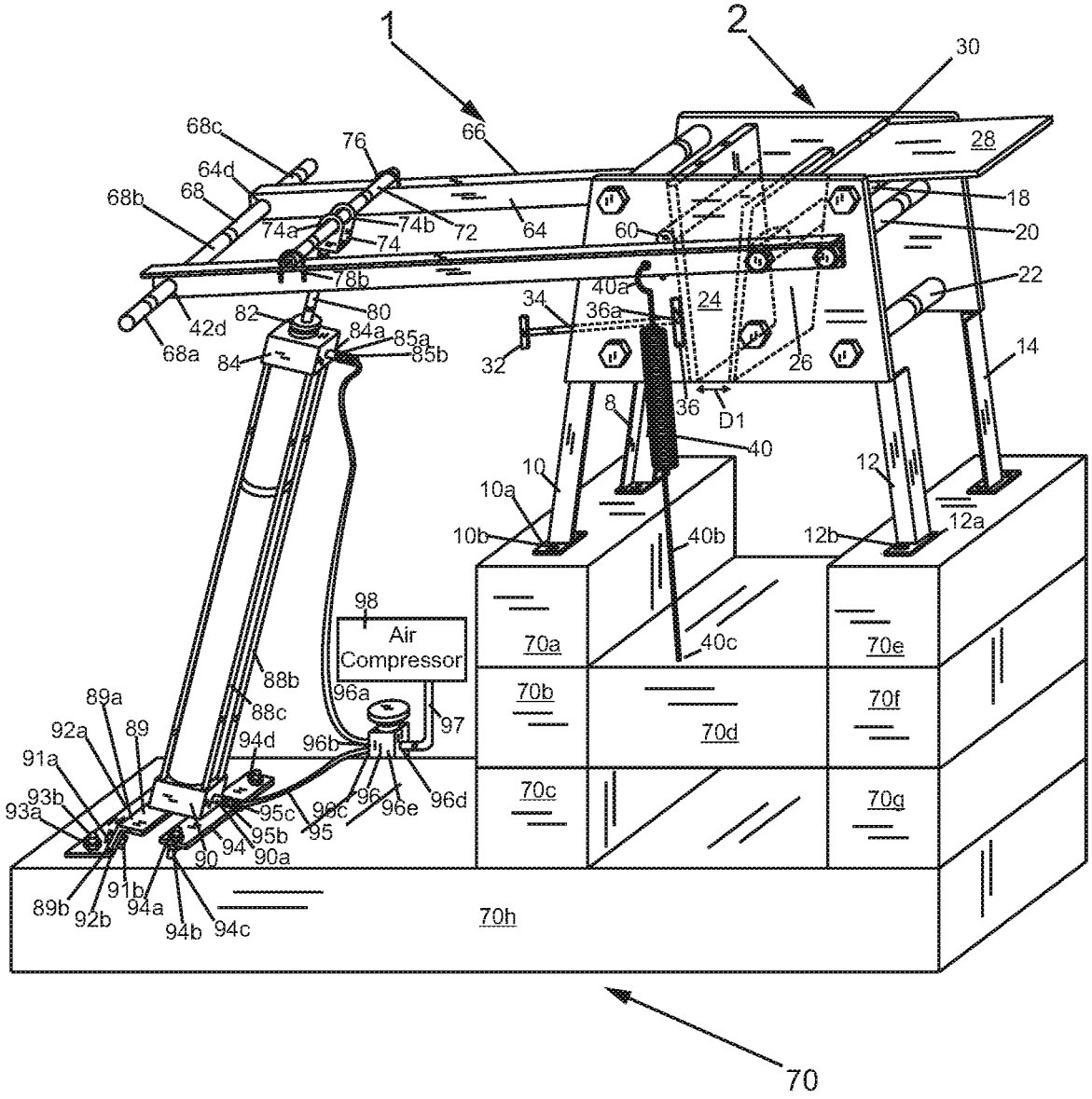
FIG. 4 is a top, front, and right perspective view of the apparatus of FIG. 1, with the apparatus shown in the first state, and with the locations of various components shown by dashed lines.

FIG. 3 is a top, front, and right perspective view of the apparatus 1 of FIG. 1, with the apparatus shown in a second state, where a cover 28 has been rotated about a pin 30 to cover the area between plates 24 and 26 where rocks would go. The apparatus 1 may be operated with the cover 28 in a covered position as in FIG. 3. The cover 28 is used as a safety measure to prevent rocks from jumping out when force is applied to the rocks.

FIG. 4 is a top, front, and right perspective view of the apparatus 1 of FIG. 1, with the apparatus 1 shown in the first state, and with the locations of various components shown by dashed lines.

Figure 5:
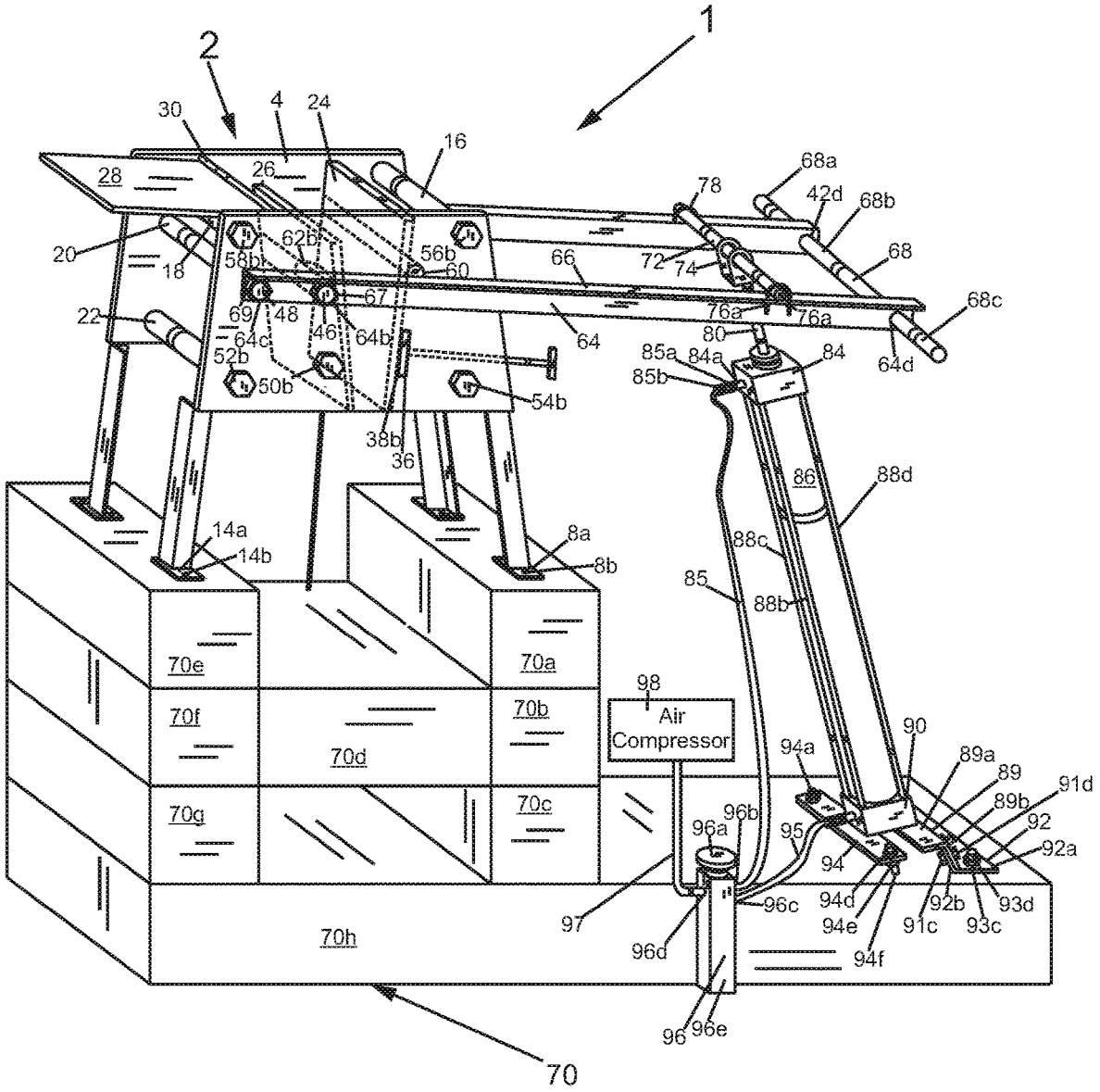
FIG. 5 is a top, front, and left perspective view of the apparatus of FIG. 1, with the apparatus shown in the first state, and with the locations of various components shown by dashed lines.

FIG. 5 is a top, front, and left perspective view of the apparatus 1 of FIG. 1, with the apparatus 1 shown in the first state, and with the locations of various components shown by dashed lines.

FIG. 6 is a top, front, and right perspective view of the apparatus of FIG. 1, with the apparatus 1 shown in a third state, and with the locations of various components shown by dashed lines.

In at least one embodiment, the piston rod 80 may have a length, L1, of about fourteen inches, shown by a dashed line in FIG. 6, when the piston rod 80 fully expands. Each of the sections 70*a*, 70*b*, 70*c*, 70*e*, 70*f*, and 70*g*, may be three and one half inches in height H1, by three and one half inches in width W1 (which are denominated commercially as four by four lumber, as shown for section 70*e* in FIG. 1.

In at least one embodiment, the air compressor 98 preferably puts out 8.0 CFPM (cubic feet per minute) of air at the air pressure of 90.0-100.0 PSI (pounds or pound force per square inch) for the apparatus 1 to work optimally. The air compressor 98 typically includes or is connected to a power source. The switch 96, in at least one embodiment, doesn't need any electricity to work; the switch 96 will work once enough pressure is built up in a tank of the air compressor 98. The switch 96 functions as a gate, in at least one embodiment, wherein when someone applies force in the direction D3 by stepping on button 96*a*, the gate opens, letting air from the compressor 98 pass through to operate the piston assembly 81 and when force is no longer being applied in the direction D3, the button 96*a* is released and the gate closes, making the piston assembly 81 return to its idle state of FIG. 1.

In at least one embodiment of the present invention, an end of the overall piston housing, which may include piston housing or cylinder 86 and member or housing 90, may be mounted at a height of approximately H3 above a ground surface, to the base 70 through brackets or members 89, 92 and 94. The height H3 may be about five inches. In contrast a height H2, shown in FIG. 1, at which the bottom end of the legs or supports 8, 10, 12, and 14 are mounted may be about fourteen inches, which is substantially greater than the height H3. This substantial difference in height level between H2 and H3 is preferred and provided to allow a relatively large piston cylinder 86 so that more force can be generated, and ends of bars 42, 44, 64, and 66 can be moved, and the bars 42, 44, 64, and 66 rotated to a sufficient extent to adequately crush rocks between the plates 24 and 26 of the rocket crusher 2.

The piston cylinder 86 may be about eighteen inches long, which is preferred in at least one embodiment to provide adequate lift force to lift ends of bars 42, 44, 64, and 66, and rotate with respect to member or bar 48.

The legs or supports 8, 10, 12, and 14 may have base plates 8*a*, 10*a*, 12*a*, and 14*a* fixed to or incorporated with them at their respective ends that are fixed to the base 70. The base plates 8*a*, 10*a*, 12*a*, and 14*a* may be fixed to the base 70 by bolts or fasteners 8*b*, 10*b*, 12*b*, and 14*b*, inserted through openings in base plates 8*a*, 10*a*, 12*a*, and 14*a*, respectively, shown by the combination of FIGS. 1 and 2.

The combination of one or more of components 40, 40*a*, 40*b*, and 40*c*, 70*a-h*, 70, 72, 74, 74*a*, 76, 76*a-b*, 78, 78*a-b*, 80, 81, 82, 84, 84*a-b*, 85*b*, 86, 88*a-d*, 89, 89*a-b*, 90, 91*a-d*, 92, 93*a-d*, 94, 94*a-f*, 95, 96, 96*a-e*, 97 and 98, may be called an assistance device and this assistance device is combined with the known rock crusher 2, to form apparatus 1 in accordance with an embodiment of the invention. The assistance device may alternatively use an electric motor to move a rod, such as rod 80 and to thereby move the bars 42, 44, 64, and 66 and rotate them with respect to bar 48 to thereby crush rocks in between plates 24 and 26. However, in at least one embodiment, the piston assembly 81 and the air compressor 98, along with components as shown in FIGS. 1-6 is preferred. The switch 96 may actually be merely a gate which allows air to flow into an inner chamber of piston cylinder 86, and the switch 96 in at least one embodiment does not require any electricity to function as a gate, in response to pushing toward or stepping on button 96*a* in the direction D3.

Alternatively or additionally, in at least one embodiment, rocks may be crushed on the downstroke when someone releases the switch button 96*a* of switch 96 and when the at least one bar of bars 42, 44, 64, and 66 comes downwards and the piston rod 80 retracts.

Although the invention has been described by reference to particular illustrative embodiments thereof, many changes and modifications of the invention may become apparent to those skilled in the art without departing from the spirit and scope of the invention. It is therefore intended to include within this patent all such changes and modifications as may reasonably and properly be included within the scope of the present invention's contribution to the art.

We claim:

1. An apparatus comprising:

a manually operated rock crusher which includes a first bar and a second bar;

wherein the first bar and the second bar are configured to be moved together manually to cause the crushing of rocks;

wherein the manually operated rock crusher includes a first plate and a second plate, wherein the manually operated rock crusher is configured to crush rocks between the first plate and the second plate in response to manual movement of the first bar together with the second bar;

wherein the first bar and the second bar are substantially parallel to each other, and spaced apart from each other, and the first and second plates are between the first bar and the second bar;

and further comprising a third bar having a first end fixed to the first bar and an opposing second end fixed to the second bar;

a piston rod connected to the third bar between the first and second ends of the third bar;

wherein movement of the piston rod causes the third bar to move to thereby cause the first and second bars to move;

wherein the piston rod is connected to the third bar so that movement of the first and second bars in any direction does not disconnect the piston rod from the third bar; and further comprising a spring;

a base; and a piston housing from which the piston rod is configured to move outward, and into which the piston rod is configured to retract;

wherein the piston housing has a first end and an opposing second end;

wherein the second end of the piston housing is fixed to the base and is located closer to the base than the first end of the piston housing;

wherein the spring is attached at a first end to the first bar and at an opposing second end to the base, so that when the first bar is rotated with respect to the base from a first orientation to a second orientation, the first end of the spring is pulled by the first bar away from the second end of the spring, while the second end of the spring is held attached to the base, to cause the spring to expand and to exert a force on the first bar which is substantially opposite a force applied by the piston rod to the first and the second bars when the piston rod moves outward from the piston housing;

wherein the apparatus is configured so rotation of the first bar, together with the second bar, with respect to the base, from the second orientation back to the first orientation, as caused at least partially by the force exerted by the spring on the first bar, causes a rock to be crushed between the first plate and the second plate and by movement of the first plate with respect to the second plate;

wherein the manually operated rock crusher has at least four legs, wherein the manually operated rock crusher is configured and the spring is attached so that when the manually operated rock crusher is standing upright with the at least four legs on a level surface, parallel to a ground surface, the force exerted by the spring on the first bar works with gravity to cause rotation of the first bar from the second orientation back to the first orientation; and wherein the second end of the spring is located at a substantially higher height than a height of the second end of the piston housing, with respect to a ground surface, when the base is on the ground surface so that the manually operated rock crusher is upright.

2. The apparatus of claim 1 further comprising a handle;

wherein the handle is fixed to the first bar and the second bar and projects outward from the first bar and the second bar; and and wherein the third bar is located between the handle and the first plate of the manually operated rock crusher.

3. An apparatus comprising:

a manually operated rock crusher which includes a first bar and a second bar;

wherein the first bar and the second bar are configured to be moved together manually to cause the crushing of rocks;

wherein the manually operated rock crusher includes a first plate and a second plate, wherein the manually operated rock crusher is configured to crush rocks between the first plate and the second plate in response to manual movement of the first bar together with the second bar;

wherein the first bar and the second bar are substantially parallel to each other, and spaced apart from each other, and the first and second plates are between the first bar and the second bar;

and further comprising a third bar having a first end fixed to the first bar and an opposing second end fixed to the second bar;

a piston rod connected to the third bar between the first and second ends of the third bar;

wherein movement of the piston rod causes the third bar to move to thereby cause the first and second bars to move;

wherein the piston rod is connected to the third bar so that movement of the first and second bars in any direction does not disconnect the piston rod from the third bar; and further comprising a spring;

a base; and a piston housing from which the piston rod is configured to move outward, and into which the piston rod is configured to retract;

wherein the piston housing has a first end and an opposing second end;

wherein the second end of the piston housing is fixed to the base and is located closer to the base than the first end of the piston housing;

wherein the spring is attached at a first end to the first bar and at an opposing second end to the base, so that when the first bar is rotated with respect to the base from a first orientation to a second orientation, the first end of the spring is pulled by the first bar away from the second end of the spring, while the second end of the spring is held attached to the base, to cause the spring to expand and to exert a force on the first bar which is substantially opposite a force applied by the piston rod to the first and the second bars when the piston rod moves outward from the piston housing;

wherein the apparatus is configured so rotation of the first bar, together with the second bar, with respect to the base, from the second orientation back to the first orientation, as caused at least partially by the force exerted by the spring on the first bar, causes a rock to be crushed between the first plate and the second plate and by movement of the first plate with respect to the second plate;

wherein the manually operated rock crusher has at least four legs, wherein the manually operated rock crusher is configured and the spring is attached so that when the manually operated rock crusher is standing upright with the at least four legs on a level surface, parallel to a ground surface, the force exerted by the spring on the first bar works with gravity to cause rotation of the first bar from the second orientation back to the first orientation;

wherein the piston housing is fixed to a first section of the base so that when the base sits on a ground surface, the piston housing is at an angle of about seventy-five degrees with respect to the ground surface, and wherein the angle remains the same during outward movement of the piston rod from the piston housing and during retraction movement of the piston rod into the piston housing;

wherein the first end of the piston housing is further away from the first section of the base than the second end of the piston housing;

the manually operated rock crusher has a plurality of base plates which are fixed to a second section of the base; and wherein the second section of the base has a substantially higher height with respect to a ground surface than the first section of the base when the base is on the ground surface, and the manually operated rock crusher is upright.

4. The apparatus of claim 3 further comprising an air compressor; and wherein the air compressor supplies air to the piston housing to cause the piston rod to move outward from the piston housing.

5. A method comprising the steps of:

connecting a first bar and a second bar of a manually operated rock crusher to a first end of a third bar, and an opposing second end of the third bar, respectively;

connecting a first end of a piston rod to the third bar between the first and second ends of the third bar to thereby connect the piston rod to the manually operated rock crusher;

wherein the first bar and the second bar are configured to be moved together manually to cause the crushing of rocks;

wherein the manually operated rock crusher includes a handle;

wherein the handle has a first section, a second section, and a central section between the first and second sections;

wherein the central section is between the first bar and the second bar;

wherein the first section extends outward from the first bar away from the central section;

wherein the second section extends outward from the second bar away from the central section;

wherein the third bar and the central section of the handle are spaced apart from each other;

wherein the manually operated rock crusher includes a first plate and a second plate, wherein the manually operated rock crusher is configured to crush rocks between the first plate and the second plate in response to manual movement of the first bar together with the second bar;

wherein the first section, the second section, and the central section of the handle are further away from the first plate and the second plate than the third bar;

wherein the first section and the second section of the handle are configured to be gripped by a first hand and a second hand of a person simultaneously while the first end of the piston rod is connected to the manually operated rock crusher so that the handle is configured to be used to apply manual force to the first bar and to the second bar which combines with force provided to the first bar and the second bar by the piston rod;

wherein the first bar and the second bar are substantially parallel to each other, and spaced apart from each other, and the first and second plates are between the first bar and the second bar;

wherein movement of the piston rod causes the third bar to move to thereby cause the first and second bars to move when the first bar and the second bar of the manually operated rock crusher are connected to the first end of the third bar, and the opposing second end of the third bar, respectively, and the first end of the piston rod is connected to the third bar between the first and second ends of the third bar;

wherein the piston rod is connected to the third bar so that movement of the first and second bars in any direction does not disconnect the piston rod from the third bar;

wherein the manually operated rock crusher is configured to crush rocks when the third bar is connected to the first bar and the second bar and the piston rod is connected to the third bar and when the third bar is disconnected from the first bar and the second bar and the piston rod is thereby disconnected from the manually operated rock crusher; and wherein a first end of a spring is located at a substantially higher height than a height of a first end of a piston housing, with respect to a ground surface, when a base is on the ground surface so that the manually operated rock crusher is upright.

6. The method of claim 5 wherein further comprising attaching a second end of the spring to the first bar and the opposing first end of the spring to the base;

wherein the piston rod is configured to move outward from the piston housing, and to retract into the piston housing;

wherein the piston housing has a second end and the opposing first end of the piston housing;

wherein the first end of the piston housing is fixed to the base and is located closer to the base than the second end of the piston housing;

wherein the spring exerts a force to the first bar which is substantially opposite a force applied by the piston rod to the first and the second bars when the piston rod moves outward from the piston housing;

wherein the spring is attached at the second end to the first bar and at the opposing first end to the base, so that when the first bar is rotated with respect to the base from a first orientation to a second orientation, the second end of the spring is pulled by the first bar away from the first end of the spring, while the first end of the spring is held attached to the base, to cause the spring to expand and to exert a force on the first bar which is substantially opposite a force applied by the piston rod to the first and the second bars when the piston rod moves outward from the piston housing, rotating the first bar, together with the second bar, from the second orientation back to the first orientation, at least partially by the force exerted by the spring on the first bar, to cause a rock to be crushed between the first plate and the second plate and by movement of the first plate with respect to the second plate; and wherein the manually operated rock crusher has at least four legs, wherein the manually operated rock crusher is configured and the spring is attached so that when the manually operated rock crusher is standing upright with the at least four legs on a level surface, parallel to a ground surface, the force exerted by the spring on the first bar works with gravity to cause rotation of the first bar from the second orientation back to the first orientation.

7. The method of claim 5 wherein the third bar is configured to be disconnected from the first bar and the second bar, without altering the manually operated rock crusher in any manner.

8. The method of claim 5 further comprising attaching the spring at a second end to the first bar and at the opposing first end to a base, so that when the first bar is rotated with respect to the base from a first orientation to a second orientation, the second end of the spring is pulled by the first bar away from the first end of the spring, while the first end of the spring is held attached to the base, to cause the spring to expand and to exert a force on the first bar which is substantially opposite a force applied by the piston rod when the piston rod is connected to the manually operated rock crusher when the piston rod moves outward from the piston housing; and detaching the spring from the first bar without moving any part of the manually operated rock crusher; and wherein the manually operated rock crusher is configured to crush rocks when the spring is attached to the first bar, and when the spring is detached from the first bar.

9. The method of claim 8 wherein the spring is configured to be detached from the first bar without altering the manually operated rock crusher in any manner.

10. A method comprising the steps of:

connecting a first bar and a second bar of a manually operated rock crusher to a first end of a third bar, and an opposing second end of the third bar, respectively;

connecting a first end of a piston rod to the third bar between the first and second ends of the third bar to thereby connect the piston rod to the manually operated rock crusher;

wherein the first bar and the second bar are configured to be moved together manually to cause the crushing of rocks;

wherein the manually operated rock crusher includes a handle;

wherein the handle has a first section, a second section, and a central section between the first and second sections;

wherein the central section is between the first bar and the second bar;

wherein the first section extends outward from the first bar away from the central section;

wherein the second section extends outward from the second bar away from the central section;

wherein the third bar and the central section of the handle are spaced apart from each other;

wherein the manually operated rock crusher includes a first plate and a second plate, wherein the manually operated rock crusher is configured to crush rocks between the first plate and the second plate in response to manual movement of the first bar together with the second bar;

wherein the first section, the second section, and the central section of the handle are further away from the first plate and the second plate than the third bar;

wherein the first section and the second section of the handle are configured to be gripped by a first hand and a second hand of a person simultaneously while the first end of the piston rod is connected to the manually operated rock crusher so that the handle is configured to be used to apply manual force to the first bar and to the second bar which combines with force provided to the first bar and the second bar by the piston rod;

wherein the first bar and the second bar are substantially parallel to each other, and spaced apart from each other, and the first and second plates are between the first bar and the second bar;

wherein movement of the piston rod causes the third bar to move to thereby cause the first and second bars to move when the first bar and the second bar of the manually operated rock crusher are connected to the first end of the third bar, and the opposing second end of the third bar, respectively, and the first end of the piston rod is connected to the third bar between the first and second ends of the third bar;

wherein the piston rod is connected to the third bar so that movement of the first and second bars in any direction does not disconnect the piston rod from the third bar;

wherein the manually operated rock crusher is configured to crush rocks when the third bar is connected to the first bar and the second bar and the piston rod is connected to the third bar and when the third bar is disconnected from the first bar and the second bar and the piston rod is thereby disconnected from the manually operated rock crusher;

wherein a piston housing is fixed to a first section of a base, so that when the base sits on a ground surface, the piston housing is at an angle of about seventy-five degrees with respect to the ground surface, and wherein the angle remains the same during outward movement of the piston rod from the piston housing and during retraction movement of the piston rod into the piston housing;

further comprising fixing a plurality of base plates of the manually operated rock crusher to a second section of the base; and wherein the piston housing has a first end and a second end, wherein the first end is further away from the first section of the base than the second end; and wherein the second section of the base has a substantially higher height with respect to a ground surface than the first section of the base when the base is on the ground surface, and the manually operated rock crusher is upright.

11. The method of claim 10 further comprising supplying air to the piston housing to cause the piston rod to move outward from the piston housing.

* * * * *